US005991922A

United States Patent [19]

Banks

[11] Patent Number: 5,991,922

[45] Date of Patent: Nov. 30, 1999

[54] MONITORED STATIC ELECTRICITY DISSIPATION GARMENT

[76] Inventor: David L. Banks, 7362 W. 87th St., Los Angeles, Calif. 90045

[21] Appl. No.: 08/992,502

[22] Filed: Dec. 17, 1997

Related U.S. Application Data

[63] Continuation-in-part of application No. 08/777,167, Dec. 26, 1996, Pat. No. 5,715,536, and a continuation-in-part of application No. 08/950,096, Oct. 14, 1997.

[51] Int. Cl.[6] ..... H05F 3/02; A41D 13/02

[52] U.S. Cl. ..... 2/69; 2/902; 361/212; 361/220

[58] Field of Search ..... 2/69, 901, 902; 361/212, 220, 223, 224

[56] References Cited

U.S. PATENT DOCUMENTS

| | | | |
|---|---|---|---|
| 4,422,483 | 12/1983 | Zins . | |
| 4,590,623 | 5/1986 | Kitchman . | |
| 4,596,053 | 6/1986 | Cohen et al. . | |
| 4,639,825 | 1/1987 | Breidegam | 361/212 |
| 4,676,561 | 6/1987 | Barrett . | |
| 4,680,668 | 7/1987 | Belkin . | |
| 4,868,710 | 9/1989 | Powell . | |
| 5,004,425 | 4/1991 | Hee . | |
| 5,184,275 | 2/1993 | Wiegel et al. . | |
| 5,426,870 | 6/1995 | Purnell et al. . | |
| 5,440,444 | 8/1995 | Adams . | |
| 5,548,469 | 8/1996 | Adams . | |
| 5,715,536 | 2/1998 | Banks . | |

OTHER PUBLICATIONS

Novx Corporation, "ESD: Back to Basics", Nov. 12, 1997, p. 1–6.

Semiconductor Equipment and Materials International "Electrostatic Compatibility—Guideline for Reducing Equipment Interruption, Particle Attraction, and Electro–static Discharge Problems Caused by Static Charge"; Apr. 16, 1997, p. 1–15.

*Primary Examiner*—John J. Calvert
*Assistant Examiner*—Shirra L. Jenkins
*Attorney, Agent, or Firm*—Jack C. Munro

[57] ABSTRACT

A monitored static electricity dissipation garment which is to be connected to a voltmeter which is to display to the wearer of the garment the amount of static electricity that is on a human's body at any given instant. The monitor can be located separate from the garment or can be worn on the garment. When the monitor is worn on the garment, it is necessary that the human user wear electrically conductive boots that have electrically conductive soles which function to dissipate static electricity on an electrically conductive floor.

20 Claims, 5 Drawing Sheets

MONITORED STATIC ELECTRICITY DISSIPATION GARMENT

REFER TO PRIOR APPLICATION

This application is a continuation-in-part of patent applications Ser. Nos. 08/777,167, filed Dec. 26, 1996, now U.S. Pat. No. 5,715,536 and 08/950,096, filed Oct. 14, 1997, both by the same title and the same inventor.

BACKGROUND OF THE INVENTION

1. Field of the Invention

The field of this invention relates to garments and more particularly to a garment that is designed primarily to minimize static electricity generated in a controlled environment such as a clean room.

2. Description of the Prior Art

It is well known that electrons repel each other. If enough electrons are present on a given object, the expulsion force may be so great that an escape path is created which is in the form of an arc. An electrostatic discharge, the arc, is basically a sudden and violent redistribution of electrons between two different bodies. On a human body, the electrostatic charge positions itself on the outside skin of the human body.

In the electronics industry, charged human bodies are the killer of components. Electronic components are becoming ever so more sensitive to static electricity. A human walking across the room would likely pick up hundred's of volts of static electricity. This would be a tremendously high voltage when dealing with present day electronic equipment Present day electronic equipment of more advanced type requires that voltage be less than one volt when building or working on the equipment. If the path of the sudden electrostatic discharge happens to include sensitive electronic devices, destruction or a significant amount of damage is quite common. In the manufacturing of some extremely sensitive computer hard drives, the manufacturers are experiencing up to seventy percent rejection because of damage due to static electricity.

In the past, there has been substantial effort expended to dissipate static electricity from workers. One of the common ways that static electricity is dissipated from a worker is by means of a conductive garment worn by the worker which is electrically connected to the exterior surface of the body of the worker. An electrical conductive grounding wire connects to the garment to electrical ground. Also, it is known for the workers to wear shoes or boots that have electrically conductive soles.

One of the disadvantages of the prior art static electricity dissipation garments is that the garment must be grounded in order for it to be effective. What is common is that the worker disconnects the ground wire to move to a different location, comes back to the first location and forgets to reconnect with the grounding outlet. Then when the worker goes back to work, static electricity flows through the electronic equipment which results in equipment damage.

Another disadvantage of the prior art static electricity dissipation garments is the lack of a positive connection between the garment and the boots. The garment is to be connected to an electrical ground and the boots are for the purpose of dissipating any static electricity in the areas of the worker's feet with this dissipation of static electricity being through the floor on which the worker is positioned. Even if the garment of the worker becomes disconnected from the electrical ground, so long as the garment is connected to the boots, there would be an electrically conductive path for the static electricity.

Another disadvantage of prior art static electricity dissipation garments is that the worker is not able to ascertain if there is an undesirable level of static electricity on the worker's body. In the past, there has been no connection of the garment to a voltmeter with this voltmeter to produce a reading which is to be displayed to the worker informing the worker that there is a potential damaging amount of static electricity on the worker's body.

SUMMARY OF THE INVENTION

The primary objective of the present invention is to construct a static electricity dissipation garment which is connectable to a voltage indicating device such as a voltage annunciator or a voltmeter (hereinafter called a voltmeter)so that the amount of voltage, which is on a human body, can be ascertained and an immediate determination can be made whether the voltage is at an equipment damaging level.

Another objective of the present invention is to construct a static electricity dissipation garment which connects through an electrically conductive ribbon with electrically conductive grounding boots through an electrical conductive ribbon which produces a positive discharge path so that static electricity from the human body can be discharged through the boots into an electrically conductive floor.

The garment of the present invention can be constructed as a pant suit, a smock or any other type of garment which is intended to be worn as an over-garment about the clothing of a human worker. The garment is manufactured to include a mass of electrically conductive threads. Also included within the garment is a strategic arrangement of an electrically conductive ribbon which is designed to pick up static electricity from the body and from the electrically conductive threads and conduct such to a grounding wire. This grounding wire is connected to an appropriate electrical grounding outlet. Instead of the grounding outlet, the static electricity may be conducted to electrically conductive boots with these boots having electrically conductive soles which dissipate the static electricity into electrically conductive flooring. The garment also includes a voltage reading circuit for connection to a monitor. The reading circuit is separate and spaced from the dissipation circuit. The reading circuit is connected to a voltmeter which displays a level which is representative of the voltage that the garment is from electrical ground. The voltmeter may be mounted on a workbench or other similar type of mounting position located spaced from the garment with an electrical wire being connecting between the voltmeter and the garment, or the voltmeter could be manufactured to be small enough so that it may be worn on the garment directly.

DETAILED DESCRIPTION OF THE PREFERRED EMBODIMENT

Figures 1, 2, 3, 4:
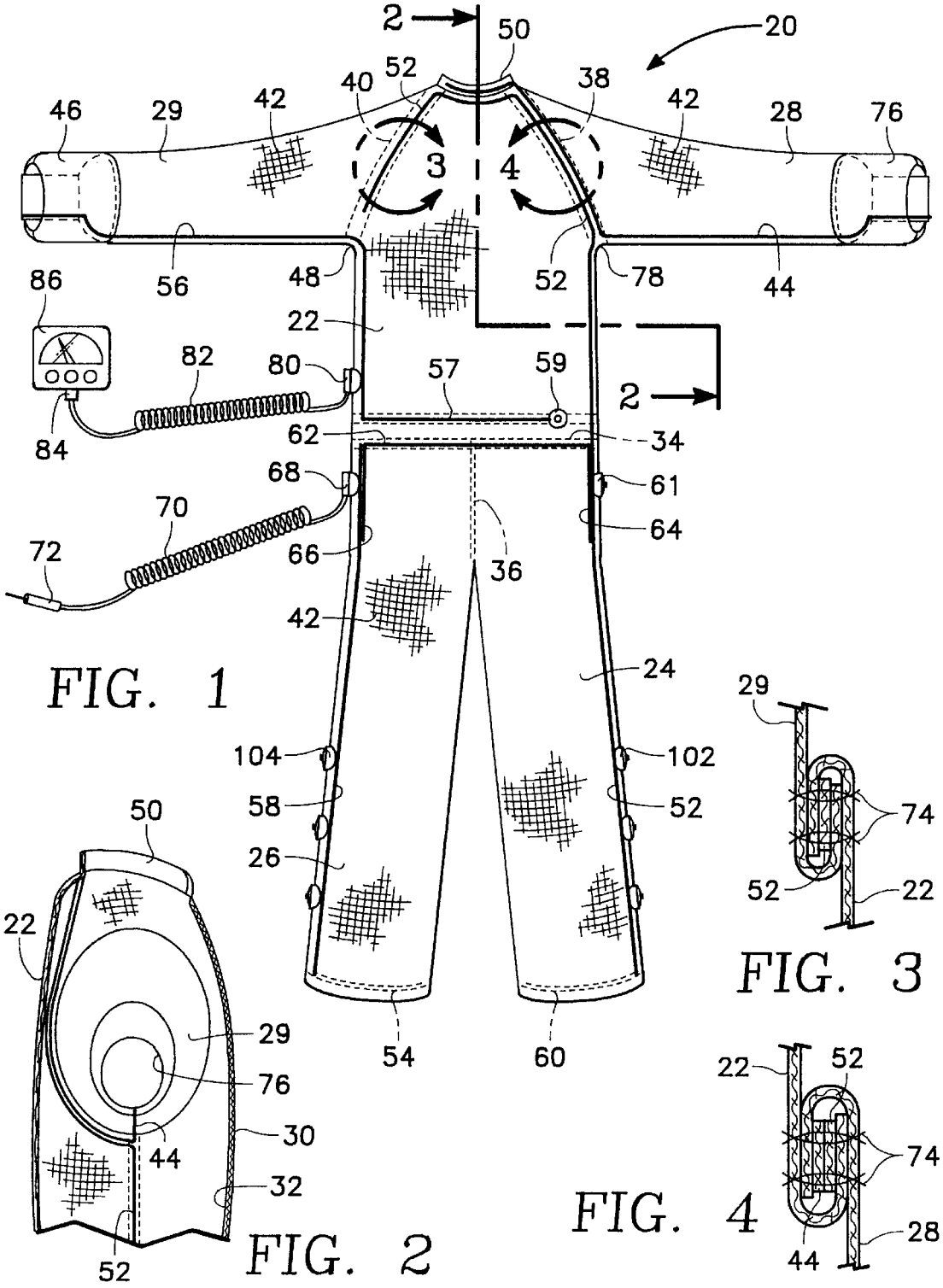
FIG. 1 is a back view of the monitored static electricity dissipation garment of this invention showing the version of the garment that is to be connected to a grounding wire and connected to a voltmeter located spaced from the garment.
FIG. 2 is a transverse cross-sectional view through the center portion of the garment of FIG. 1 taken along line 2—2 of FIG. 1.
FIG. 3 is a cross-sectional view through a single layer of one of the electrically conductive ribbons mounted within the garment of FIG. 1 taken along line 3—3 of FIG. 1.
FIG. 4 is a cross-sectional view through a double layer of electrically conductive ribbon included within the garment of FIG. 1 taken along line 4—4 of FIG. 1.

Referring particularly to the drawings, there is shown in FIGS. 1–4 the pant suit configuration of garment 20 constructed in accordance with this invention. The pant suit 20 is formed of a torso section 22 to which are attached a pair of leg sections 24 and 26. Extending from the torso section 22 in opposite directions are a pair of arm sections 28 and 29. Within the front panel of the torso section 22 there is included a zipper 30. The pant suit 20 forms an internal chamber 32. A human, is to be located within the internal chamber 32 with generally the garment 20 being worn as an over-garment.

The leg sections 24 and 26 are joined to the torso section 22 at a cross seam 34. The leg sections 24 and 26 are also joined together at a crotch seam 36. Arm section 28 is attached to the torso section 22 at an arm seam 38. Arm section 29 is attached to the torso section 22 at an arm seam 40. The leg sections 24 and 26 are of the same length and are located in juxtaposition. The arm sections 28 and 29 are also of the same length and are in alignment with each other but extend in opposite directions.

A typical material of construction of the entire pant suit 20 would be a thermoplastic fabric type of material such as a polyester within which are woven strands 42 of electrically conductive fiber. Typically, the strands 42 are spaced about one-quarter of an inch apart and are located in a crisscross pattern forming a checkerboard appearance. Formed within the garment 20 is a static electricity dissipation circuit which utilizes in part an electrically conductive ribbon 44. The ribbon 44 has a width of about a fourth of an inch and is about the thickness of conventional fabric. The ribbon 44 is basically constructed of a thermoplastic type fabric such as polyester or nylon with there being incorporated in the ribbon 44 a mass of closely spaced-apart electrically conductive fibers. The result is that the ribbon 44 comprises an exceedingly good electrical conductor. One length of the ribbon 44 extends from the cuff 76 of the sleeve section 28 down to the underarm section 78 and then upward within the arm seam 38 to the collar 50 and then across the collar 50 where it is terminated. A second length of ribbon 52 extends from the arm seam 38, across the collar 50, and then part way down the arm seam 40. Ribbon 52 also extends down the torso section 22 and all the way along the leg section 24 terminating at a leg section seam 60. It is important that the ribbon 44 and ribbon 52 be in tight contact with each other so as to form a positive electrical conductance therebetween. It is important to note that the ribbon 52 traverses about three-quarters of the length of the arm seam 40. The reason for this is so that the ribbon 52 will remain spaced from the ribbon 56 which will be referred to later on in the specification as a reading circuit.

As part of the static electricity dissipation circuit, there is an electrically conductive ribbon 58 which extends down the leg section 26 and connects with the leg section seam 54 located at the outer end of the leg section 26. Ribbon 58 connects to transverse section 62 which is located within the seam 34. Transverse section 62 has extensions 64 and 66 with extension 64 connecting with the ribbon 52 that extends along side of leg section 24 and extension 66 connecting with ribbon 58 which extends along side of leg section 26. The extension 64 is tightly bound in electrical connection with the ribbon 52 and extension 66 is tightly bound in electrical connection with ribbon 58.

The extension 66 includes an electrical connector 68 which is electrically connected to both ribbon 58 and ribbon extension 66. The extension 64 includes an electrical connector 61 which can connect to electrical wire 70 rather than connect with electrical connector 68. The electrical connector 68 is permanently attached to electrical wire 70 which terminates in a plug connector 72. Plug connector 72 is to be plugged into an appropriate electrical grounding socket, which is not shown, located exteriorly of the garment 20.

In referring particularly to FIG. 3 of the drawings, it can be seen that the bonding of the fabric of the sleeve section 29 to the torso section 22 and single ribbon 52 is accomplished by sewing at seam 40 and producing stitches 74. In FIG. 4, the sleeve section 28 is bonded to torso section 22 across double ribbons 44 and 52 at seam 38 by stitches 74.

The electrically conductive ribbon 56 extends from the cuff 46 of the arm section 29 to the underarm section 48 and then alongside of the torso section 22 to an electrical connector 80. From the electrical connector 80 the ribbon 56 includes an extension 57 that extends across the torso and terminates in an electrical connector 59. Connecting with the electrical connector 80 is an electrical wire 82. The electrical wire 82 terminates in a plug 84 with this plug 84 to be connected to a voltmeter 86. The voltmeter 86 is to function to display a value for the amount of voltage which is being sensed by the sensing circuit composed of the ribbon 56.

When a human is using the garment 20, the plug 84 is to be connected to the voltmeter 86 which will be located at some exterior location such as on a workbench. Also, on that workbench is to be located a grounding socket which connects with the plug 72. The static electricity from the human is conducted onto the garment 20 and is conducted by strands 42 to the ribbons 52, 44, 62 and 58 which constitute the dissipation circuit. The vast majority of the area of the garment 20 is dissipated of static electricity through the electrical wire 70 and the plug 72. The reading circuit, composed of ribbon 56, is to ascertain the amount of voltage on the garment 20 with the voltage that is transmitted through the ribbon 56 being read by the voltmeter 86. However, the voltage within the sleeve 29 is able to be conducted by the strands 42 to the dissipation circuit.

Although the garment 20 is shown as a pant suit, it may comprise a different type of garment such as a smock. Also, the garment may comprise an equipment cover such as a robot cover, machinery cover, dust cover, etc.

Figure 5:
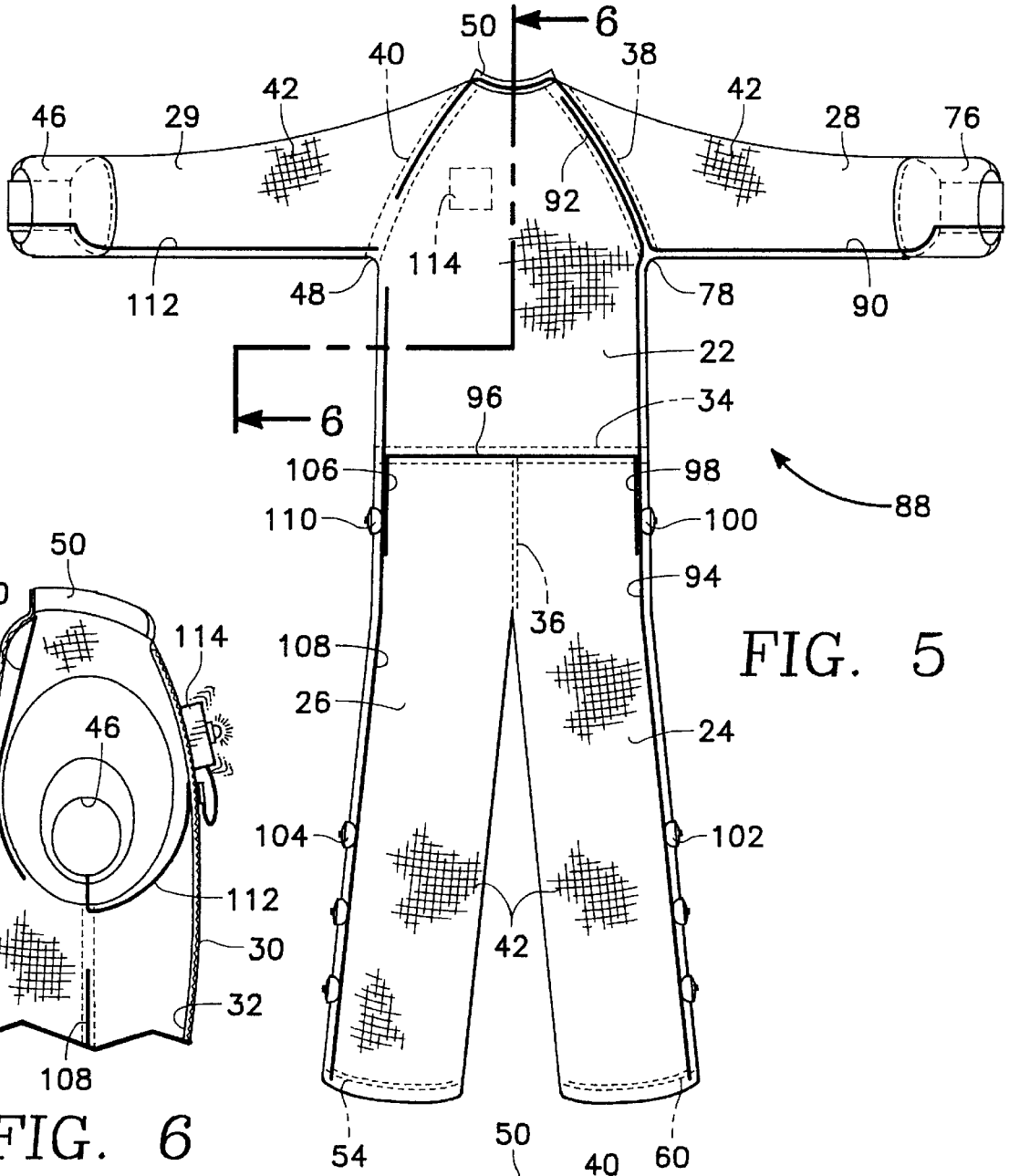
FIG. 5 is a back view similar to FIG. 1 but of a version of a garment which includes a voltmeter mounted on the garment thereby eliminating the need for the external electrical connections that are used in FIG. 1.
Figure 6:
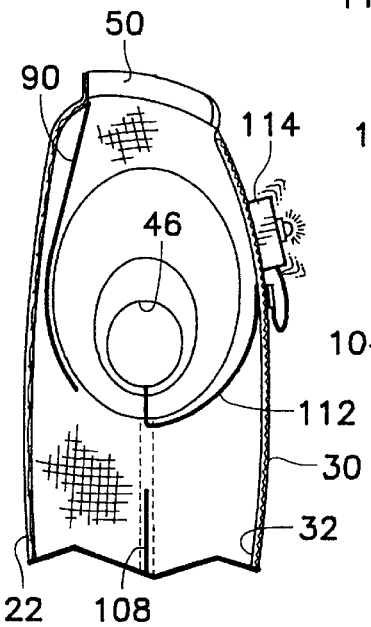
FIG. 6 is a longitudinal cross-sectional view taken along line 6—6 of FIG. 5.
Figure 7:
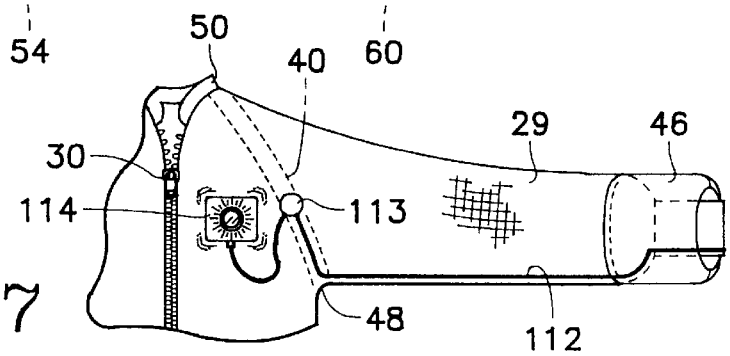
FIG. 7 is a front view of the left arm and upper torso area of the garment of FIG. 5.

Referring particularly to FIG. 5–7 of the drawings, there is a second embodiment 88 of garment where like numbers of garment 20 have been utilized to refer to like parts. One of the differences of the second embodiment 88 from the garment 20 is that the ribbon 90 of sleeve 28 passes through seam 38, across collar 50 and down seam 40 stopping short of ribbon 112. In garment 20, ribbon 44 stopped at collar 50. Ribbon 92 is stitched to ribbon 90 in seam 38 and is integrally connected with ribbon 94 which extends the entire length of the leg section 24. A transverse ribbon 96 connects with the ribbon 92 by means of extension 98 and electrically connecting snap 100. The snap 100 can be used to connect the second embodiment 88 to an electrical wire such as wire 70, however such is not mandatory.

The dissipation of the electrical energy from the dissipation circuit of the second embodiment 88 is to be accomplished by electrically conductive boots which will be described further on in the specification. These boots are to be connected to any one of the snaps 102 mounted on the leg section 24 and to a snap 104 mounted on leg section 26. For a detailed explanation of the snap connectors, reference is to be had to prior referenced patent application 08/950,096. The transverse ribbon section 96 includes an extension 106 which is electrically connected with ribbon 108 which extends from the torso section 22 all the way down the leg section 26 to the seam 54. Mounted in conjunction with the extension 106 is a snap electrical connector 110 which is to be utilized for the same purpose as the snap electrical connector 100. The dissipation circuit for the second embodiment 88 then comprises ribbons 90, 92, 94, 96 and 108.

Included within the arm section 29 is an electrically conductive ribbon 112. Ribbon 112 connects to voltmeter 114 through electrical connector 113 which provides a continuous reading of the voltage which is on the second embodiment 88 of garment 20. The voltmeter 114 is mounted on the front of the torso section 22 directly adjacent the zipper 30. The reading circuit then comprises basically the left arm section 29. Note there is no direct connection to ground. Such devices sense ion flow in air and are commercially available from NOVX Corporation of San Jose, California. Although the reading circuit only "reads" the left arm, it should be representative of the entire human body and garment 88. The user is to be able to quickly observe and ascertain the voltage that is on the second embodiment 88. Only when the user determines that the amount of voltage is less than a predetermined value, will that individual be able to come into contact with the sensitive electronic components, which are not shown.

Figure 8:
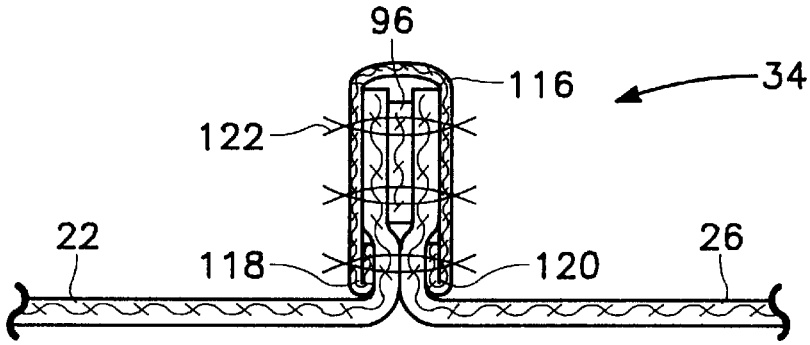
FIG. 8 is a cross-sectional view of a version of how the electrically conductive ribbon could be mounted in conjunction with exclusively the fabric garment.

Referring particularly to FIG. 8, there is shown one way in which a seam, such as seam 34, could be manufactured. The seam in FIG. 8 is shown being connected to the leg section 26. However, it is to be understood that an identical seam would be constructed between the torso section 22 and the leg section 24.

A free edge of the torso section 22 is located in juxtaposition with a free edge of the leg section 26. In between these edges, there is located the ribbon 96. Placed over the combined sandwich of the edges of the torso section 22 and the leg section 26 is a fabric cover 116. The edges of the fabric cover 116 are folded over upon itself forming overlapped sections 118 and 120. The fabric cover 116, as well as the edges of the torso section 22 and the leg section 26, are then sewn tightly in conjunction with the ribbon 96 by stitches 122. The seam of FIG. 8 is intended to be used when the conductive fiber filaments 42 are more on the outside of the fabric which is defined as a "raised grid". Where the conductive fiber filaments 42 are impregnated within the fabric 124, which by way of example could comprise a torso section 22, reference is to be had to FIG. 9 of the drawings.

Figure 9:
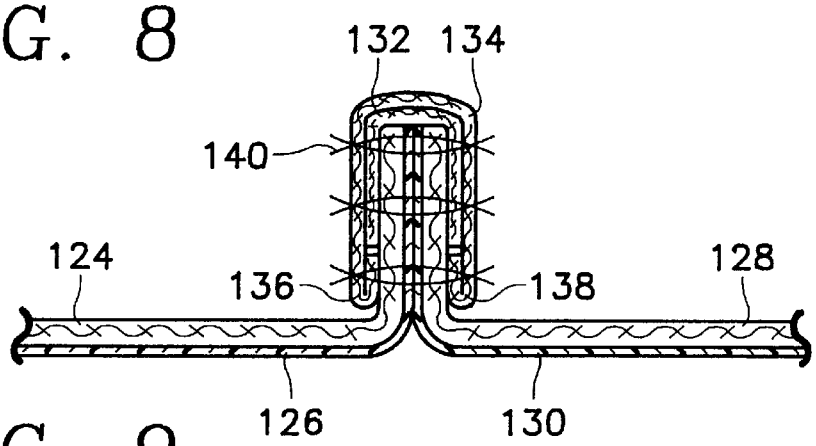
FIG. 9 is a cross-sectional view of yet a further version of mounting of the electrical conductive ribbon in connection with the garment where the exterior surface of the garment includes a plastic coating over the fabric.

The fabric 124 of FIG. 9 is laminated to a plastic layer 126. The fabric layer 126 could comprise a coating applied in liquid form then dried to form the flexible layer 126. The torso section 22 is to be attached to a leg section which is composed of fabric 128 and plastic layer 130. The edges of the fabric 124 and 128 are located in an abutting relationship with the plastic layers 126 and 130 physically contacting. A U-shaped electrically conductive ribbon 132 is mounted about the joined edges of fabric with a fabric cover 134 then covering the electrically conductive ribbon 132. The edges of the fabric cover 134 are overlapped on itself forming overlapped sections 136 and 138. These overlapped sections 136 and 138 are for the purpose of completely covering of the electrically conductive ribbon 132 relative to the ambient. The entire arrangement of FIG. 9 is then sewn together by stitches 140.

Figure 10:
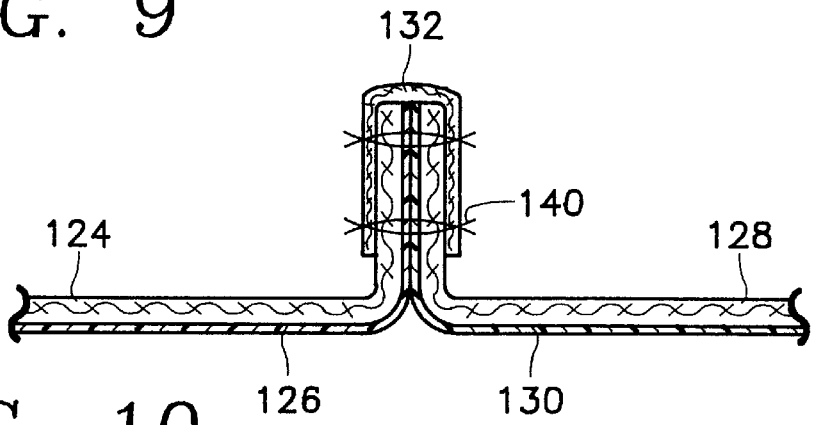
FIG. 10 is a cross-sectional view of yet a further version of electrically conductive ribbon in conjunction with the garment as shown in FIG. 9 with FIG. 10 showing an intermediate constructional step in the manufacture of the ribbon.
Figure 11:
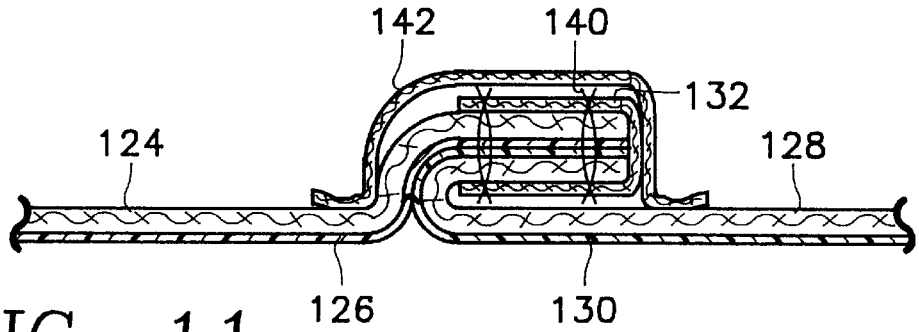
FIG. 11 is a cross-sectional view of the ribbon in FIG. 10 showing it in the completed manufacturing position.

If it is desired to make the seam shown in FIG. 9 in a flat configuration, reference is to be had to the construction technique of FIGS. 10 and 11 where like numbers are used to refer to like parts. The only difference is that stitches 140 are applied only across the electrically conductive ribbon 132 and the edges of the fabric 124 and 128. The seam configuration instead of extending substantially perpendicular is then folded over to about a ninety degree angle as shown in FIG. 11. When in that position, the then constructed seam is then covered by a fabric cover 142. Securing of the fabric cover 142 to the fabric 124 can be accomplished by heat sealing. The stitches 140 do not connect with the fabric cover 142.

Figure 12:
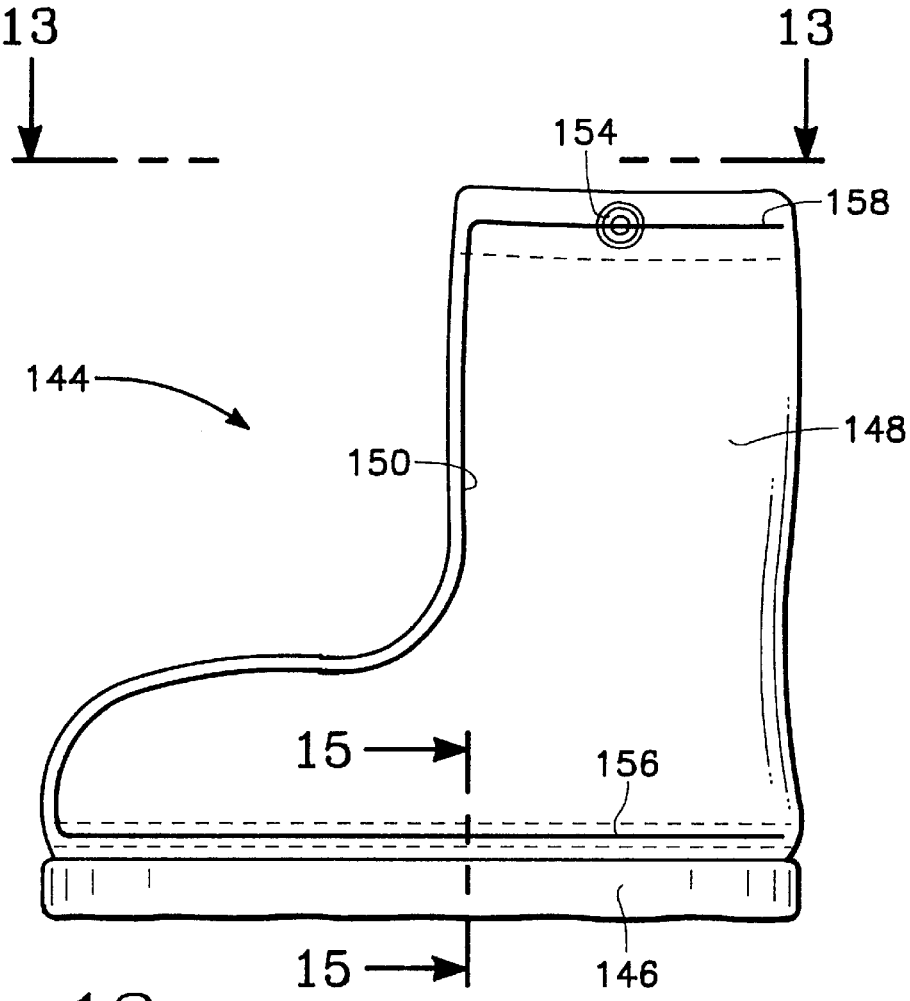
FIG. 12 is a side elevational view of a boot that is intended to be used with the garment of FIG. 5.
Figure 13:
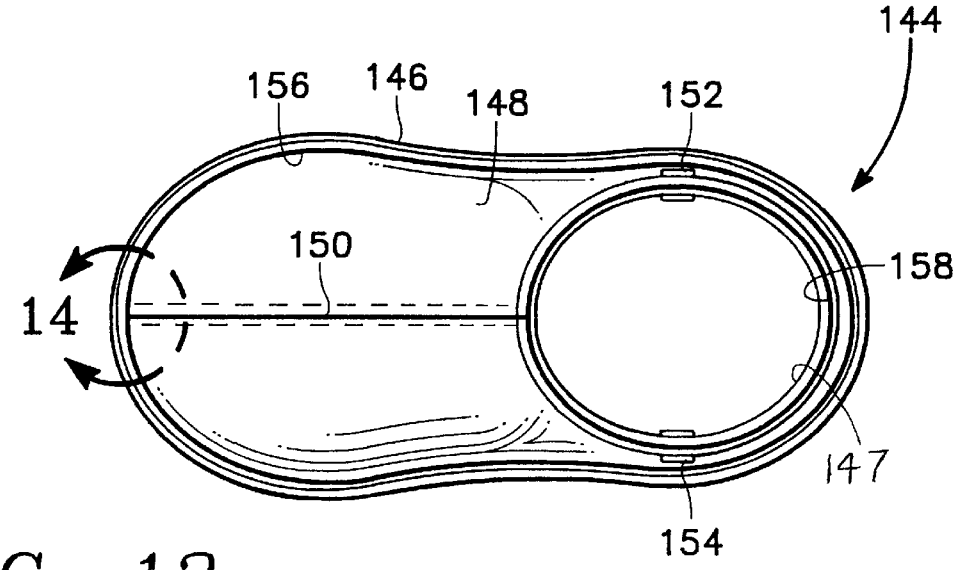
FIG. 13 is a top plan view of the boot taken along line 13—13 of FIG. 12.

Referring particularly to FIGS. 12 and 13 of the drawings, there is shown an electrically conductive boot 144 constructed in accordance with this invention. The boot 144 has an electrically conductive sole 146 on which is mounted an upper 148. The sole 146 is deemed to be conventional and can be obtained from any of several manufacturers with one manufacturer being Stern & Stern Industries, Inc. located in New York City, N.Y. The model number of the Stern & Stern sole is Chemstat 939 Plus.

Mounted within the upper 148 is an electrically conductive ribbon 150. The ribbon 150 connects to a pair of electrical connectors in the form of snaps 152 and 154 which are located directly adjacent the access opening 147 within the boot 144 to the sole 146. The electrically conductive ribbon 150 includes a sole section ribbon 156 which extends all the way around the sole 146. The electrically conductive ribbon 150 extends from the sole section 156 along the longitudinal center of the upper 148 until it reaches the upper section of the electrically conductive ribbon 158 which connects with the snaps 152 and 154. Snap 152 is to be connectable with any one of the three snaps 102 located on the leg section 24 with snap 154 being connectable with any one of the three snaps 104 located on the leg section 26. It is to be understood that the reason there are three in number of the snaps 104 and 102 so as to adjust for different height of individuals wearing the garment 20 or the second embodiment of garment 88. The result is that when utilizing of the second embodiment 88, the energy dissipation circuit is to conduct the static electricity into the ribbon 150 of each of the boots 144. The static electricity from the ribbon 150 is conducted into the sole section ribbon 156 and hence exteriorly of the boot through the sole 146.

Figure 14:
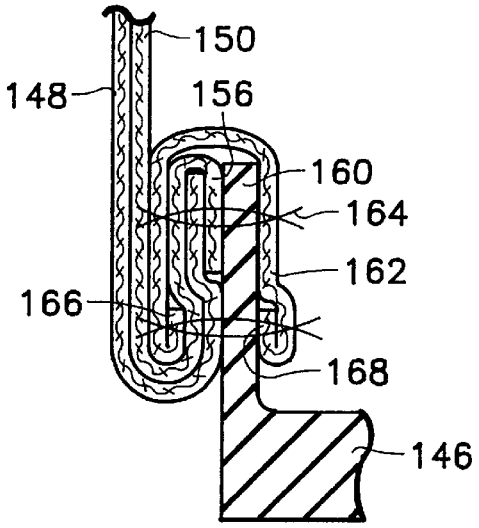
FIG. 14 is a cross-sectional view through the toe area of the boot taken along line 14—14 of FIG. 13 with the ribbon mounted on the outside of the sole.
Figure 15:
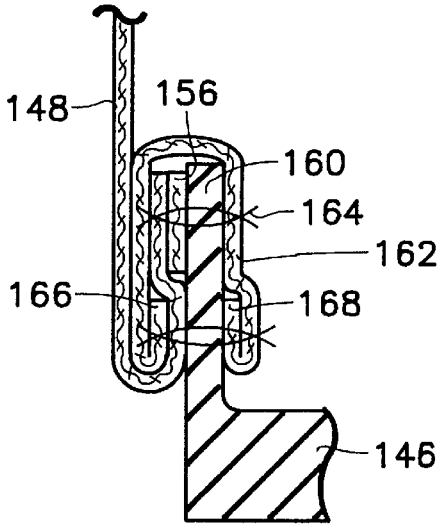
FIG. 15 is a cross-sectional view through the ribbon connection to the sole of the boot taken along line 15—15 of FIG. 12 again with the ribbon mounted on the outside of the sole.

Referring particularly to FIGS. 14 and 15 of the drawings, the sole 146 includes an upwardly extending flange 160 which is located around the entire periphery of the sole 146. The ribbon, composed of sections 150, 156 and 158 are mounted within a seam of the upper 148 for protection purposes. The ribbon section 156 and a portion of the ribbon 150 that is connected directly to the section 156 is then covered by a seam cover 162 and then sewn to the upwardly extending flange 160 by means of stitches 164. The cover 162 has overlapped edges 166 and 168 which function to totally encase the ribbon 156 from the ambient.

Figure 16:
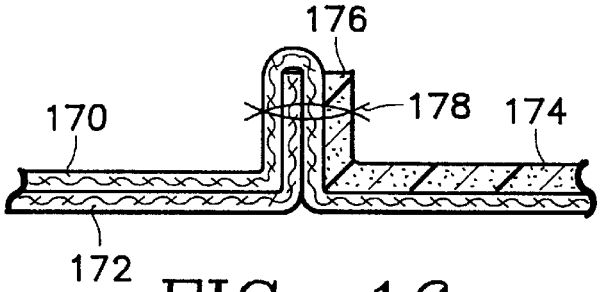
FIG. 16 is a cross-sectional view showing the mounting of the ribbon within the interior surface of the boot showing the initial manufacturing step of attaching the ribbon to an innersole of the boot.
Figure 17:
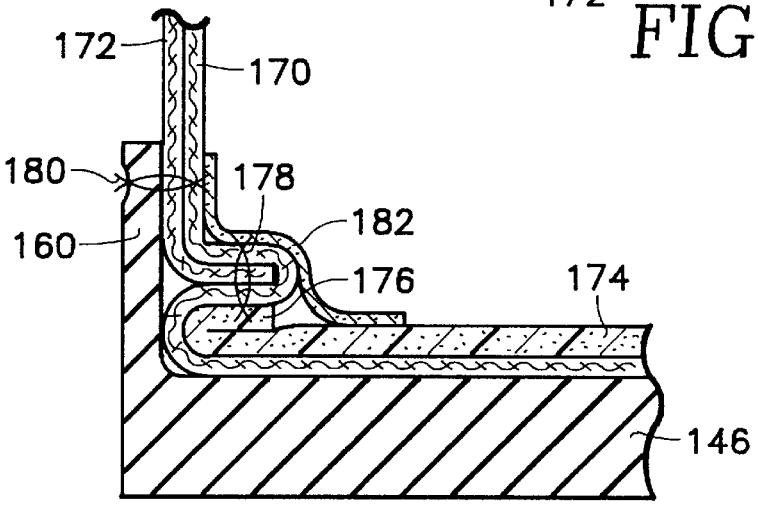
FIG. 17 is a cross-sectional view showing the ribbon and innersole installed within the boot.

In FIGS. 14 and 15, the ribbon 156 is mounted on the exterior surface of the upwardly extending flange 160. However, it may be desirable to mount the ribbon on the interior surface of the upwardly extending flange 160. Reference is to be had to FIG. 16 which shows a ribbon 170 being mounted in connection with a boot upper 172, and a boot innersole 174. The innersole 174 has an upwardly extending flange 176 which is located about the entire periphery of the innersole 174. The upwardly extending flange 176, ribbon 170 and the upper 172 are sewn together by stitches 178. In the manufacturing of the boot, the upper 172 and ribbon 170 is tilted ninety degrees which causes the upwardly extending flange 176 to be pivoted over into contact with the innersole 174. This structural arrangement is then stitched by stitches 180 to the upwardly extending flange 160 which results in construction of the boot. It is normally desired to cover the inside surface of the layers which are stitched together by the stitches 178. Therefore, a cover 182 is provided. The cover 182 is to be secured in position by being heat sealed or by an adhesive.

What is claimed is:

1. A monitored static electricity dissipation garment comprising:

a garment adapted to be worn about the torso of a wearer, said garment being constructed of a fabric which is impregnated throughout with a plurality of electrically conductive threads;

said garment including a first electrically conductive ribbon forming a dissipation circuit, said first electrically conductive ribbon being electrically connected to said electrically conductive threads, said dissipation circuit to function as a collector of static electricity from said electrically conductive threads;

electrical discharge means connected to said garment and said first electrically conductive ribbon, said electrical discharge means to function to remove the collected static electricity from said first electrically conductive ribbon and discharge such exteriorly of said garment;

a reading circuit included within said garment, said reading circuit being separate and spaced from said dissipation circuit, said reading circuit including a second electrically conductive ribbon which is also electrically connected to said electrically conductive threads; and a voltmeter connected to said reading circuit, said voltmeter to produce a value representative of the residual voltage of the static electricity on said garment.

2. The monitored static electricity dissipation garment as defined in claim 1 wherein:

said electrical discharge means comprising a pair of electrically conductive boots which are worn about the feet of the human, each said boot having an electrically conductive sole, said sole being electrically connected to said ribbon, whereby during walking there will be at least one boot in contact with an electrical conductive floor.

3. The monitored static electricity dissipation garment as defined in claim 1 wherein:

said electrical discharge means comprising a wire connector which is adapted to connect with an exterior electrical conductive ground.

4. The monitored static electricity dissipation garment as defined in claim 1 wherein:

said voltmeter being mounted on said garment and being free of any outside connection.

5. The monitored static electricity dissipation garment comprising:

a garment adapted to be worn about the torso of a wearer, said garment being constructed of a fabric which is impregnated throughout with a plurality of electrically conductive threads;

said garment including an electrically conductive ribbon which is electrically connected to said electrically conductive threads, said ribbon to function as a collector of static electricity from said electrically conductive threads; and a pair of electrically conductive boots to be worn about the feet of a human, each said boot having an electrically conductive sole, each said sole being electrically connected to said ribbon, whereby said static electricity from said garment is to be discharged exteriorly of said boot by said sole establishing an electrically conductive relationship with an exterior object.

6. The monitored static electricity dissipation garment as defined in claim 5 wherein:

each said boot having an upper, a boot ribbon mounted on each said boot, said boot ribbon functioning to conduct static electricity from said garment to said sole.

7. An assembly to maintain a human relatively free of static electricity and to indicate operation of said assembly comprising:

a garment adapted to be worn by a wearer, said garment including:

a sheet material including;

means which make said sheet material at least partly electrically conductive;

a first electrically conductive ribbon forming a static electricity dissipation circuit, said first electrically conductive ribbon being electrically connected to said sheet material to conduct static electricity therefrom;

electrical discharge means adapted to be connected to an electrical ground connected to said first electrically conductive ribbon to discharge static electricity from said first electrically conductive ribbon to the electrical ground;

a second electrically conductive ribbon spaced from said first electrically conductive ribbon, which is also electrically connected to said sheet material; and a device connected to said second electrically conductive ribbon capable of indicating differences in electrical potential between said garment and the electrical ground.

8. The assembly as defined in claim 7 wherein said electrical discharge means include:

at least one foot covering having;

an electrically conductive sole electrically connected to said first electrically conductive ribbon, for use with an electrically grounded floor.

9. The assembly as defined in claim 7 wherein said garment further includes:

a first sleeve constructed from said sheet material;

a second sleeve constructed from said sheet material;

a torso constructed from said sheet material;

a first sleeve seam connecting said first sleeve to said torso; and a second sleeve seam connecting said second sleeve to said torso, whereby said first electrically conductive ribbon is positioned within said first sleeve seam to make electrical contact between said sheet material of said first sleeve and said torso, and wherein second electrically conductive ribbon is positioned within said second sleeve seam to make electrical contact between said sheet material of said second sleeve and said torso.

10. The assembly as defined in claim 9 wherein said garment further includes:

a first torso seam; and a first torso electrically conductive ribbon mounted within said first torso seam to make electrical contact with said sheet material of said torso.

11. The assembly as defined in claim 10 wherein:

said first torso electrically conductive ribbon is mounted in direct electrical contact with said first electrically conductive ribbon.

12. The assembly as defined in claim 10 wherein:

said first torso electrically conductive ribbon and said first electrically conductive ribbon are constructed at least in part from a unitary piece of electrically conductive ribbon.

13. The assembly as defined in claim 10 wherein said garment further includes:

a second torso seam; and a second torso electrically conductive ribbon mounted within said second torso seam to make electrical contact with said sheet material of said torso.

14. The assembly as defined in claim 13 wherein:

said second torso electrically conductive ribbon is mounted in direct electrical contact with said second electrically conductive ribbon.

15. The assembly as defined in claim 9 wherein said garment includes:

a first sheet of said sheet material; and a second sheet of said sheet material, and wherein said first sleeve seam includes;

a first outer edge portion of said first sheet of said sheet material;

a first inner edge portion of said first sheet of said sheet material;

a second outer edge portion of said second sheet of said sheet material; and a second inner edge portion of said second sheet of said sheet material, whereby said first conductive ribbon and said edge portions are formed in a stack with said first inner edge portion being in contact with said second outer edge portion, said second outer edge portion being in electrical contact with said first conductive ribbon, said first conductive ribbon being in electrical contact with said first outer edge portion, and said first outer edge portion being in contact with said second inner edge portion.

16. The assembly as defined in claim 15 wherein said first sleeve seam includes:

stitching extending through said stack to retain said edge portions and said first conductive ribbon in electrical contact.

17. The assembly as defined in claim 9 wherein said garment torso includes:

a first leg; and a second leg, said garment further including:

a second torso seam spaced from said first torso seam; and a second torso electrically conductive ribbon positioned within said second torso seam to make electrical contact with said sheet material in said torso, said first torso seam extending along said first leg and said second torso seam extending along said second leg.

18. The assembly as defined in claim 13 where in said garment further includes:

a first electrically conductive boot having;

a first releasable electrical connector;

a second boot having;

a second releasable electrical connector, wherein said first torso seam includes;

a first electrical connector positioned for connection to said first releasable electrical connector, and wherein said second torso seam includes;

a second electrical connector positioned for connection to said second releasable electrical connector.

19. The assembly as defined in claim 7 wherein:

said device connected to said second electrically conductive ribbon capable of indicating voltage present on said garment includes;

a connection adapted to be connected to the electrical ground; and an annunciator to indicate when a level of electrical potential between said garment and the electrical ground is present.

20. The assembly as defined in claim 7 wherein:

said device connected to said second electrically conductive ribbon capable of indicating voltage present on said garment includes;

a sensor of electrical flow adjacent said garment indicating an electrical potential between the garment and the electrical ground; and an annunciator to indicate when a level of electrical potential between said garment and the electrical ground is sensed by said sensor.

* * * * *